United States Patent [19]

Bettcher

[11] 4,334,451

[45] Jun. 15, 1982

[54] SLICING APPARATUS HAVING ROTARY MAGAZINE

[75] Inventor: Louis A. Bettcher, Amherst, Ohio

[73] Assignee: Bettcher Industries, Inc., Birmingham, Ohio

[21] Appl. No.: 172,657

[22] Filed: Jul. 28, 1980

[51] Int. Cl.[3] ..... B26D 7/01

[52] U.S. Cl. ..... 83/703; 83/409.2; 83/411 A

[58] Field of Search ..... 83/703, 409.1, 409.2, 83/411 R, 411 A, 733

[56] References Cited

U.S. PATENT DOCUMENTS

| | | | |
|---|---|---|---|
| 3,428,102 | 2/1969 | Knecht et al. | 83/703 X |
| 3,434,519 | 3/1969 | Bettcher | 83/411 A |
| 3,587,689 | 6/1971 | Bettcher | 83/411 A |
| 3,693,684 | 9/1972 | Bettcher | 83/733 |
| 3,782,230 | 1/1974 | Bettcher | 83/409.2 X |
| 3,831,475 | 8/1974 | Bettcher | 83/411 A |

*Primary Examiner*—James M. Meister
*Attorney, Agent, or Firm*—Watts, Hoffmann, Fisher & Heinke Co.

[57] ABSTRACT

Cutting apparatus 20 for severing slices from a comestible product, especially meat bodies, having a rotary knife blade 28 and a rotary magazine 26 for moving comestible products in an endless path across the blade. The magazine has product receptacles 76, 77 constructed for convenient removal from a one-piece molded plastic supporting base 40, all of which facilitates cleaning the machine. The base 40 is received on the end of a drive shaft 30 and is adjustable in height relative to the shaft. A plate 71 secured to the shaft and clamped against the base secures the receptacles and eliminates wobble from clearance between the base and shaft. Projections 122, 123 from the plate 71 transmit rotary force between the drive shaft and base. Pusher plate assemblies 94, 96 slide along the receptacles to urge products through the magazine 26.

13 Claims, 6 Drawing Figures

SLICING APPARATUS HAVING ROTARY MAGAZINE

DESCRIPTION

1. Technical Field

This invention relates to cutting apparatus for severing slices from a comestible product or workbody; especially meat bodies, including frozen products and those having bones. More particularly, it relates to an improved rotary magazine for carrying comestible products past a slicing knife.

2. Background Art

Cutting apparatus of the general type to which this invention relates is shown in U.S. Pat. Nos. 3,434,519; 3,587,689; 3,693,684; 3,782,230; 3,831,475; and 3,985,057. The apparatus disclosed therein moves a product carried by a receptacle in an endless horizontal path past a cutter, which severs sections from the product. Advantageously, the receptacle has an inclined interior surface that directs the product downward into cutting position in response to rotational force and rearward to minimize any tendency of the product to move upward during the severing operation. Typically, the receptacles are tubular or trough-like affairs secured at a lower end to a heavy metal base, as by welding or with screws. The base is driven from a central supporting shaft. The base is about one-half inch in thickness, with openings or chambers through which the product passes and in which the bottom of the receptacles may be received. Auxiliary sheet metal walls are sometimes used in addition to the receptacles to increase the height of the chambers at the base, adjacent to the receptacles, to help support such products as soft meat.

Apparatus, such as that described above, used for processing comestible products, and especially meat products, must be kept sanitary. This necessitates frequent and thorough cleaning. As a result, it is very desirable that such apparatus be easily and quickly disassembled and reassembled to facilitate cleaning. It is also desirable that the apparatus permit replacement of components and that it be economical to manufacture and reliable in use.

DISCLOSURE OF THE INVENTION

The present invention provides new and improved cutting apparatus for severing slices from a comestible product and particularly includes an improved rotary magazine of the type referred to that is easily disassembled to facilitate cleaning, is easily and quickly reassembled for use, and that is economical to manufacture, of sturdy construction, and reliable in use.

The improved magazine has a one-piece molded plastic circular base that is supported atop a vertical drive shaft for rotation in a horizontal plane. The base has substantial height, both to receive an upper portion of the drive shaft in a central hub portion and to provide deep chambers with open top and bottom ends to receive and guide products to be sliced. Elongated receptacles extend in upright fashion from the base each serving as a support and guide for an elongated comestible product that typically initially extends well above the base.

The use of a molded plastic base, e.g., of polypropylene, is particularly advantageous. It substantially reduces the weight of the magazine, while yet providing deep chambers. Thus, the base can be light enough to be lifted onto and removed from the supporting shaft by one person, yet deep enough to avoid the need for auxiliary sheet metal walls about the front part of the chambers. Such auxiliary walls have not been totally satisfactory because of the difficulty in fitting them to the opening, securing them in place and keeping them in the original shape and condition over a period of hard use. Further, because of the memory of plastic, the base will not distort if dropped and therefore does not tend to become bent or misaligned with use. It also reduces or avoids damage to the slicing blade if hit or rubbed by the blade in use, as sometimes happens when the apparatus is adjusted for thin slicing and the blade is not perfectly aligned.

One receptacle extends from one end of each chamber, aligned with the periphery. Each receptacle is in the general shape of a trough standing on end, to receive part or all of a product received in and extending upward from the base. The bottom of the product rests on a plate beneath the base at a level below that of a rotary knife that underlies part of the rotary magazine. Rotation of the magazine carries the product into the path of the knife. The base and receptacle move the product across the knife to sever a portion that extends through the chamber and below the base. The receptacles are inclined from the vertical in the direction of rotary movement, i.e., forwardly, so the receptacles urge the products being carried in a downward direction. Also, pusher plates that slide on the receptacles rest on top of the products to impart a downward force.

In accordance with this invention, the receptacles are partially telescoped into the relatively deep base, each in inclined alignment and contact with an interior inclined side surface of the receiving chamber and releasably secured to the base in a fixed location in a manner that initially positions and retains each in place and subsequently clamps all receptacles securely to the base with a single clamp plate. This manner of fastening facilitates easy removal of the receptacles for cleaning and allows the base to be left in place on the shaft, if desired. In addition, the clamp plate when secured, holds the base fixed relative to the drive shaft to eliminate wobble otherwise caused by a clearance fit between the base and shaft.

Notwithstanding the non-unitary construction and the ease with which the receptacles are removable from the base, the magazine is extremely sturdy and capable of withstanding the impact of the work product, especially frozen products or those with bone, against the knife blade as the magazine is rotated at high speed. To this end, the telescoped portions of the receptacles, the one piece molded construction of the base, and the locating and retaining structures that position and clamp the receptacles to the base, all provide positive abutments that act against the direction of force during cutting, while permitting relative movement of the parts in directions opposite from the operating force for disassembly. This permits a "twist and remove" action for disassembly of the receptacles that is quick and convenient, yet without loss of rigidity in use.

Advantageously, the clamp plate has projections with driven and driving surfaces that interengage with both the rotary drive shaft and the molded base to transmit rotary force. This increases the area of the molded base against which the force is applied and increases the length of the moment arm through which the force is applied, reducing the tendency for the plastic base to distort or wear and cause unwanted play between the drive surfaces.

As a further feature, the base carries an annular plastic bearing plate or washer on the bottom surface that surrounds the drive shaft, which is received in a central portion or hub of the base. The washer rests on a collar fixed to the drive shaft. By adjusting the relationship of the washer or bearing plate with respect to the base, as by addition or removal of shims between the two, a desired vertical clearance between the magazine base and the underlying knife blade can be established. This clearance is maintained upon removal of the base for cleaning and is not susceptible to operator adjustment or inadvertent change the way a conventional adjustment at the shaft end would be. It also facilitates the clamping plate drive at the end of the drive shaft.

The above and other features and advantages of the invention will become better understood from the detailed description that follows, when considered in connection with the accompanying drawings.

BEST MODE FOR CARRYING OUT THE INVENTION

Figure 1:
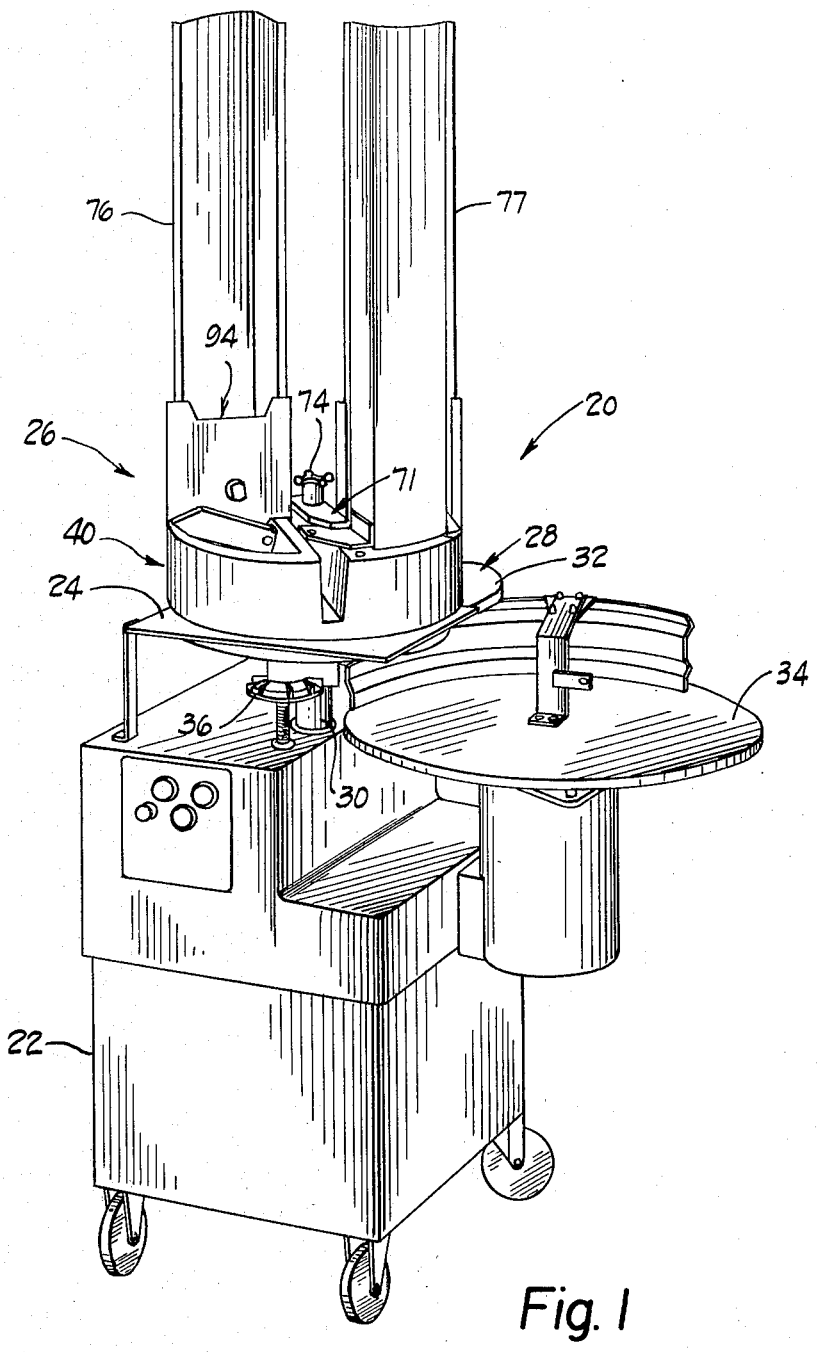
FIG. 1 is a perspective view of a cutting apparatus embodying the present invention.

Referring to the drawings, a cutting apparatus constructed in accordance with this invention is indicated generally by the reference numeral 20. The apparatus includes a wheeled stand 22 having a horizontally disposed, vertically adjustable, table 24; a rotatable magazine assembly 26 disposed above the table 24 and rotatably supported for moving one or more products through an endless path; and a rotary knife assembly 28 supported by the stand 22 and located partially in an opening or recess in the table 24. The magazine assembly 26 is carried on a vertical shaft 30, is open at the bottom, and moves products to be sliced across the rotary knife assembly 28, which has a disc-shaped horizontal blade 29 that severs a slice or section from a product as it is moved by the magazine assembly. The slice is received on a rotatable table 34 secured to the stand 22. For safety, the blade is covered by a guard 32.

The table 24 supports the bottom end of products moved by the magazine assembly and is adjustable in height relative to the rotary knife assembly 28 to change the thickness of slices to be severed from the product. This adjustment is accomplished by an adjusting wheel and screw 36. The relationship between the knife blade and magazine, the manner in which they are driven, and other ways of adjusting the table height, are all shown in the above-mentioned patents, which are hereby incorporated by reference.

Figure 2:
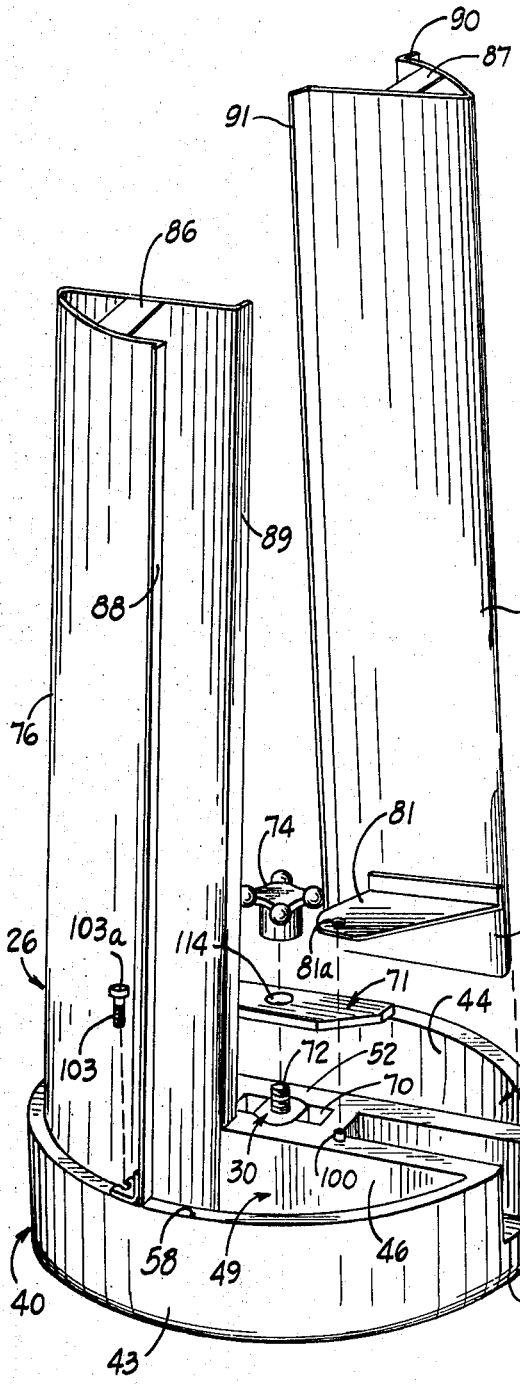
FIG. 2 is an exploded perspective view of a rotary magazine of the apparatus of FIG. 1.
Figure 5:
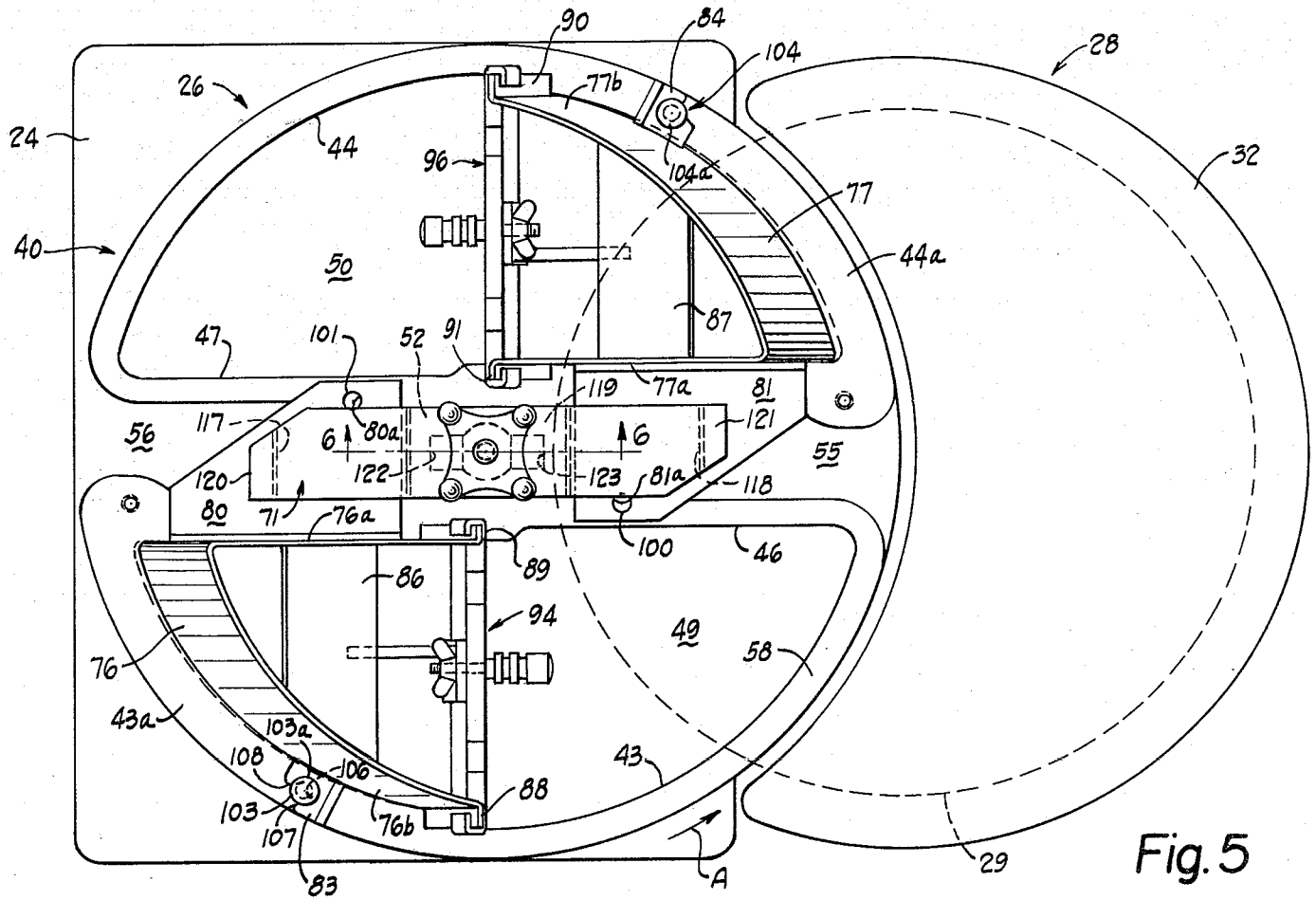
FIG. 5 is a top plan view of the rotary magazine and an adjacent portion of the cutting apparatus.

The general construction of the magazine assembly 26 is shown in FIGS. 2 and 5. The assembly includes a circular base 40 of molded plastic, having a bottom surface 41, two curved, oppositely disposed, upstanding, peripheral walls 43, 44 that are not quite semi-circular; two upstanding, parallel, transverse central walls 46, 47, each of which joins or connects opposite ends of one of the curved peripheral walls to provide two spaced, tubular, product-receiving passages 49, 50 through the base diametrically across from each other; a central hub portion 52 between the central walls; and two rectangular recesses 55, 56 on diametrically opposite sides of the hub portion, between the passages. A top surface 58 is formed by the upper surfaces of the aforementioned walls. The bottom surface, beneath the rectangular recesses 55, 56, and the upstanding walls, are of substantial thickness for strength. As best shown in FIG. 5, the semi-circular walls 43, 44 are not of uniform thickness. Rather, a portion 43*a*, 44*a* of the walls adjacent one end of each passage is tapered, i.e., thicker at the top surface 58 than at the bottom surface 41, to provide a slant to the inside surface.

Figure 6:
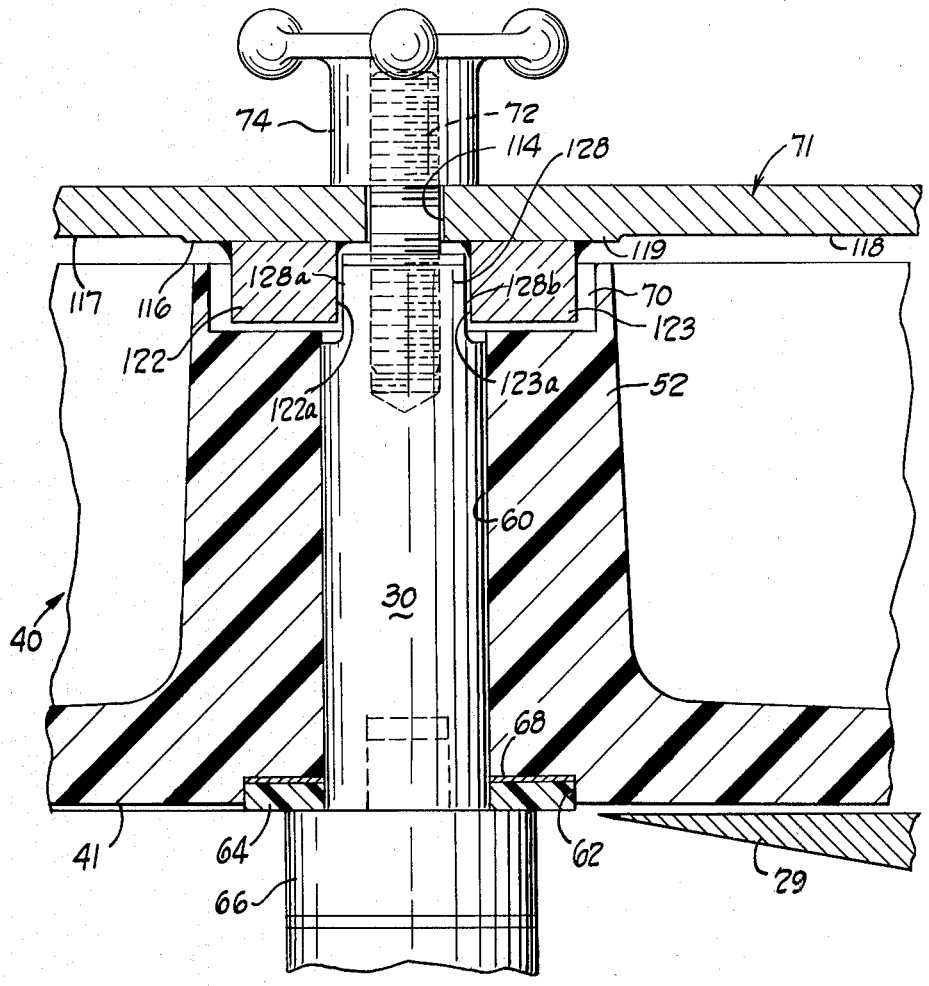
FIG. 6 is a partial, sectional, view of the rotary magazine and drive shaft taken along the line 6—6 of FIG. 5.

As shown in FIG. 6, the central hub portion 52 is generally in the form of a boss with a central cylindrical bore 60 for receiving the upper end of the vertical drive shaft 30. A recess 62 at the base of the hub portion receives a plastic bearing disc or washer 64, held in place by self-tapping screws (not shown). The plastic washer extends below the bottom surface 41 of the base and rests on a collar 66 of the shaft 30, to support the base above the rotary knife blade 29. Shims 68 are located between the washer 64 and the base of the recess 62 to permit adjustment of the clearance between the bottom surface 41 of the base 40 and the knife blade. This adjustment is not lost when the base is removed from the shaft 30. The upper end of the central hub portion 52 has a rectangular slot 70 in the top surface 58 and across the central bore 60, as also shown in FIG. 2, for facilitating a driving connection between the shaft and base, through a clamp plate 71, to transmit rotary motion. A threaded stud 72 extends from the top of the shaft 30 to receive a clamp knob 74 that acts against the plate 71 to retain the base on the shaft.

Trough-like receptacles 76, 77 are supported in an upright position, one in each passage 49, 50, at diametrically opposite ends, so that each is at the back end of its passage relative to the direction of rotation of the base across the knife, indicated by the arrow A in FIG. 5. As shown in FIG. 5, each receptacle is located against the tapered wall portion 43*a*, 44*a*.

Each receptacle 76, 77 is formed of stainless steel sheet metal, of uniform cross section, and shaped to conform to the end of the receiving passage. A lower end of each receptacle is partially telescoped within the receiving passage, resting against the tapered wall portion. The depth to which the receptacles are received is limited by a gusset-like plate 80, 81, respectively, extending at right angles from a flat wall portion 76*a*, 77*a*, respectively, and by a tab 83, 84, extending at right angles from a curved wall portion 76*b*, 77*b*, respectively. The gusset-like plates 80, 81 extend a distance sufficient to overlie both central, transverse, upstanding walls 46, 47, while the tabs 83, 84 are of a size to overlie the thickness of the curved walls 43, 44. The curved wall portions 76*b*, 77*b* are of a contour comparable to that of the curved walls 43, 44 of the base.

As best seen in FIGS. 2 and 5, the slanted portion of the semi-circular walls 43, 44, within which the receptacles are telescoped, cant or tilt the receptacles so each is inclined from the perpendicular and leans toward its open side, which faces in the direction of magazine rotation. A reinforcing brace 86, 87 extends across the top end of each receptacle, secured to the flat wall 76*a*, 77*a* and the curved wall 76*b*, 77*b*, to maintain wall spacing constant. Parallel flanges 88, 89 of the receptacle 76 and 90, 91 of the receptacle 77 extend outwardly from each open side in a common plane and support pusher plate assemblies 94, 96 that slide up and down on the receptacles and serve to urge products retained in the receptacles in a downard direction to facilitate slicing. The flanges end at the top surface 58, as best illustrated in FIG. 5, and overlie the peripheral walls 43, 44 and transverse walls 46, 47.

The receptacles 76, 77 are located and partially secured in place, each by a fixed pin 100, 101 that extends from the upper surface of the transverse wall 46, 47 of the other cavity, and by a screw 103, 104 on the semicircular wall 43, 44 of the passage in which the receptacle is received. The screws 103, 104 are set with a head **103*a*, 104*a* spaced from the top surface 58 sufficiently to receive the respective tab 83, 84 beneath the head. Each tab has a recess 106 and an open edge 107 with a lip 108 that cams around the shank of the screw 103, 104 by deflecting the receptacle wall on which the tab is secured. This results in an over-center action so the lip retains the tab about the screw shank and the receptacle in place. Each gusset-like plate 80, 81 has an aperture 80*a*, 81*a* for receiving the fixed pin 100, 101, which does not extend above the top surface of plate. By virtue of the above construction, one can, by placing the gusset-like plate in position to receive the pin of the transverse wall of the opposite passage in which the receptacle is received, and by lowering the receptacle into the proper passage until the gusset and tab rest on the top surface 58 of the base, and then pivoting the receptacle about the pin toward the undercut wall portion of the passage, slide the tab beneath the screw head to locate and retain the receptacle. The curvatures of the receptacle wall portions 76*b*, 77*b* and the base walls 43, 44** facilitate this rotational movement. The receptacles are removed in the opposite manner. Thus, the receptacles are assembled and disassembled by either inserting and twisting, or twisting and lifting, respectively.

Once the receptacles are in place, they are both secured for operation by the clamp plate 71 and the clamp knob 74. The clamp plate is elongated, with a central circular opening 114 to receive the threaded stud 72. A bottom surface 116 of the clamp plate is relieved at 117 and 118 between a central portion 119 and opposed ends 120, 121. Each end extends over and clamps against a different one of the gusset-like plates 80, 81. The relieved portions 117, 118 are spaced from the top surface of the gusset-like plates to assure that, with distortion of the plate, the clamping force is transmitted to the center of the gusset-like plates and not applied to merely the inside edges thereof.

As best shown in FIGS. 5 and 6, the clamp plate 71 has two depending projections 122, 123 in the form of rectangular blocks. Each block has two flat sides parallel to each other and extending in the longitudinal direction parallel to the transverse walls 46, 47. Also, each depending projection has a transverse wall **122*a*, 123*a* facing each other in spaced relationship on opposite sides of the opening 114. The rectangular blocks 122, 123 are sized to closely fit within the cross slot 70 in the top surface 58 of the central hub portion 52 and are spaced to straddle a reduced diameter top portion 128 of the shaft 30. The transverse walls 122*a*, 123*a* cooperate with two diametrically opposite flats 128*a*, 128*b* of the top portion of the shaft, while the side walls of the rectangular projections cooperate with opposite side walls of the cross slot 70. Thus, rotation of the drive shaft 30 rotates the clamp plate through the depending projections, which also act as a couple against opposite surfaces forming the cross slot 70 to rotate the base 40** at locations significantly displaced from the central rotational axis of the magazine.

By virtue of the clamping action of the plate 71 on opposite sides of the shaft 30, the relationship of the base 40 to the shaft is fixed to eliminate the wobble otherwise inherent between the shaft and base due to the clearance fit therebetween.

Figure 3:
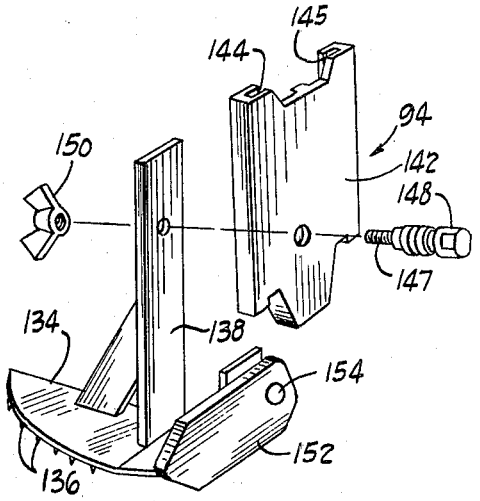
FIGS. 3 and 4 are exploded perspective views of product followers used with the magazine of FIG. 2.
Figure 4:
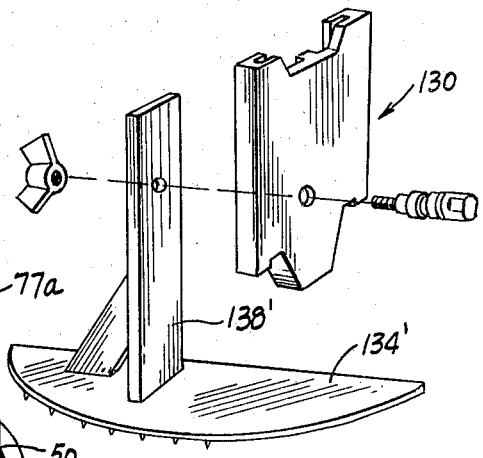

The two pusher plate assemblies 94, 96 are identical and one assembly 94 is shown in more detail in FIG. 3. A second embodiment of a pusher plate assembly 130 is shown in FIG. 4. The assembly 94 has a bottom plate 134 with projections 136 for engaging the top of a product in the receptacle. The assembly has an upright support 138 secured to the bottom plate 134, and a brace 140 between the two for rigidity. The assembly 94 also has a plastic slide 142 with inwardly facing grooves 144, 145 that receive the flanges 88, 89 or 90, 91 of the respective receptacle, and guide the assembly in sliding movement along the receptacle. The slide 142 and support 138 are held together with a screw 147 of an outwardly extending handle 148. The screw extends through apertures of the support and slide and receives a wing nut 150. The handle is used to raise the assembly 94 to an upper position when a product is inserted into the receptacle. The weight of the assembly then bears against a top surface of a product and urges it downward and inward. A retainer 152 is pivoted by a pin 154 on one side of the bottom member 134 and extends slightly below the bottom plate to help hold the top of a product in the receptable. This is desirable because of the inclined orientation of the receptacle and the fact that the cutting force on the product tends to tilt the top of the product outwardly. In addition, the bottom plate 134 is inclined at its rearward portion at an acute angle to the upright support 138 to counteract the tendency of the top portion of the product to tilt outward. The retaining plate is pivoted at one end because its free end extends beyond the width of the receptacle and contacts the top of the base of the magazine before the plate 134 reaches the bottom of the passage. The pivot allows the assembly to continue its downward movement. The assembly of FIG. 3 is especially suitable for pork tenderloin or the like, which includes bone, has an inclined upper end surface and typically is completely received within the receptacle.

The pusher plate assembly 130 of FIG. 4 is particularly suitable for fresh meat, especially meat bodies that are somewhat larger than the receptacle and extend outwardly therefrom, more completely filling the cavity of the base. The construction of the assembly 130 is similar to that of the assembly 94, except that the bottom plate 134' is perpendicular to an upright support 138', is of like size to the cavity, and carries no retainer plate.

It should be apparent from the foregoing that disassembly of the magazine 26 is relatively easy and convenient, and accomplished first by removing the clamp knob 74 and clamp plate 71, thereby simultaneously releasing both receptacles 76, 77. By then twisting the receptacle in a direction counter to the rotation of the magazine during use, the tab 83 or 84 is released from the retaining screw and the receptacle can be lifted from the base. In addition, removal of the clamping knob and plate allows removal of the base from the shaft 30. By virtue of the construction of the bearing plate or washer 64, the adjustment for clearance of the base over the knife blade is not lost upon removal and is not likely to become nonadjusted. Reassembly is accomplished in the opposite manner and both disassembly and reassembly are accomplished without the use of tools and without resetting critical adjustments. Proper canted alignment of the receptacles is established by the inclined portion of the upright walls of the base member and the gusset-like plates 80, 81. The chamber walls of the base also back up the receptacles to absorb shock from the product hitting the cutting blade during rotation of the magazine. Because of the large size of the flats on the driving projections of the clamping plate, driving force is applied at a distance from the center of rotation to avoid distortion or damage to the plastic base.

While a preferred embodiment has been described in detail, it will be apparent that modifications or alterations can be made therein without departing from the spirit and scope of the invention set forth in the appended claims.

I claim:

1. A machine for slicing comestible products, comprising a stand, a rotary knife, a product-holding magazine for moving a product past the knife, and means for rotatably supporting and driving the magazine; said magazine including a base member rotatable about a central axis, an opening through the base member for passage of product, a separable product receptacle supported by the base member, aligned with the opening, and means securing the product receptacle to the base member for convenient removal, said securing means including a location pin fixed to one of the base member and receptacle, and a receptacle retainer spaced from the pin, said receptacle pivotably engaging the locating pin and said retainer having parts on both the base member and receptacle interengageable through relative pivoting of the base member and receptacle about the pin.

2. A machine for slicing comestible products, comprising a stand, a rotary knife, a product-holding rotary magazine for moving a product past the knife, and means for rotatably supporting and driving the magazine; said magazine including a base member rotatable about a central axis, a plurality of openings through the base member for passage of products, a plurality of separable product receptacles supported by the base member, each aligned with an opening, and means securing each product receptacle to the base member for convenient removal, said securing means including a locating pin fixed to one of the base member and receptacle, a retainer spaced from the pin, and a member clamping all receptacles to the base member, each said receptacle pivotably engaging a locating pin and each said retainer having parts on both the base member and receptacle interengageable through relative pivoting of the base member and receptacle about the pin.

3. A machine for slicing comestible products, comprising a stand, a rotary knife, a product-holding rotary magazine for moving a product past the knife, and means for rotatably supporting and driving the magazine, said magazine including a base member rotatable about a central axis, a plurality of openings through the base member for passage of products, a plurality of separable product receptacles supported by the base member, each aligned with an opening, and means securing each product receptacle to the base member for convenient removal, said securing means including a gusset-like plate extending from a side of the receptacle, a locating pin fixed to one of the base member and receptacle, a retainer spaced from the pin, and a member clamping all receptacles to the base member, each said plate being pivotably connected to the base about the pin for pivotal movement of the receptacle, and said retainer having a tab with an open-sided aperture and retaining lip on one of the base member and receptacle and a headed fastener on the other interengageable through relative pivoting of the base member and receptacle about the pin.

4. A machine as set forth in claim 1, 2 or 3 in which each said opening in the base is formed by an upstanding peripheral wall having an inside surface at least a portion of which is inclined relative to said central axis, and against which portion the receptacle is located.

5. A machine for slicing comestible products, comprising a stand, a rotary knife, a product-holding rotary magazine for moving a product past the knife, and means for rotatably supporting and driving the magazine, said magazine including a base member rotatable about a central axis, an opening through the base member for passage of product, an upstanding wall forming a part of the base member, surrounding said opening and at least in part inclined relative to said axis, an elongated trough-like product receptacle supported by the base member, aligned with the opening, located against said inclined part of the wall, and inclined relative to said axis, and means removably securing the product receptacle to the base member.

6. An improved product-holding rotary magazine for a machine for slicing comestible products, such as meat, comprising a base member rotatable about a central axis, means to transmit rotational force to the member, an opening through the base member for passage of product, a separate product receptacle supported by the base member, aligned with the opening, and means securing the product receptacle to the base for convenient removal, said securing means including a locating pin fixed to one of the base member and receptacle, and a receptacle retainer spaced from the pin, said receptacle pivotably engaging the locating pin and said retainer having parts on both the base member and receptacle interengageable through relative pivoting of the base members and receptacle about the pin.

7. An improved product-holding rotary magazine for a machine for slicing comestible products, such as meat, comprising a base member rotatable about a central axis, means to transmit rotational force to the member, a plurality of openings through the base member for passage of products, a plurality of separable product receptacles supported by the base member, each aligned with an opening, and means securing each product receptacle to the base member for convenient removal, said securing means including a locating pin fixed to one of the base member and receptacle, a retainer spaced from the pin, and a member clamping all receptacles to the base member, each said receptacle pivotably engaging a locating pin and each said retainer having parts on both the base member and receptacle interengageable through relative pivoting of the base member and receptacle about the pin.

8. An improved product-holding rotary magazine for a machine for slicing comestible products, such as meat, comprising a base member rotatable about a central axis, means to transmit rotational force to the member, a plurality of openings through the base member for passage of products, a plurality of separable product receptacles supported by the base member, each aligned with an opening, and means securing each product receptacle to the base member for convenient removal, said securing means including a gusset-like plate extending from a side of the receptacle, a locating pin fixed to one of the base member and receptacle, a retainer spaced from the pin, and a member clamping all receptacles to the base member, each said plate being pivotably connected to the base about the pin for pivotal movement of the receptacle, and said retainer having a tab with an open-sided aperture and retaining lip on one of the base member and receptacle and a headed fastener on the other interengageable through relative pivoting of the base member and receptacle about the pin.

9. A magazine as set forth in claim 6, 7 or 8 in which each said opening in the base is formed by an upstanding peripheral wall having an inside surface at least a portion of which is inclined relative to said central axis, and against which portion the receptacle is located.

10. An improved product-holding rotary magazine for a machine for slicing comestible products, such as meat, comprising a base member rotatable about a central axis, means to transmit rotational force to the member, an opening through the base member for passage of product, an upstanding wall forming a part of the base member, surrounding said opening and at least in part inclined relative to said axis, an elongated trough-like product receptacle supported by the base member, aligned with the opening, located against said inclined part of the wall, and inclined relative to said axis, and means removably securing the product receptacle to the base member.

11. A machine for slicing comestible products, comprising: a stand; a rotary knife on the stand; a product-holding rotary magazine on the stand for moving a product past the knife; an upright shaft from the stand for supporting the magazine for rotation; said magazine having a molded plastic base with a tubular passage through which a product to be sliced passes, a removable receptacle secured to the base and extending from the passage, a central bearing piece secured to the bottom of the base, means for adjusting the bearing piece relative to the bottom of the base, and a central opening through the base and bearing piece; a collar on said shaft, spaced from an upper end a distance essentially equal to the height of the base at the central opening and supporting the bearing piece; and means interengaging said shaft and the base adjacent the central opening to transmit rotary motion from the shaft to the base.

12. A machine for slicing comestible products, comprising: a stand; a rotary knife on the stand; a product-holding rotary magazine on the stand for moving a product in a horizontal path past the knife; an upright shaft from the stand for supporting the magazine for rotation; said magazine having a molded plastic base with a tubular passage through which a product to be sliced passes, a removable receptacle secured to the base and extending from the passage, a central opening through the base for receiving said shaft, a recess in a top surface of the base extending on diametrically opposite sides of the central opening and having a force-transmitting surface on each said side oriented transversely to said horizontal path, a member securable to the shaft, and two spaced projections from the member extending into the recess, one on each opposite side of the central opening engaged with the force-transmitting surfaces, said projections each having a surface engaged with said shaft constructed to prevent relative rotation between the shaft and member.

13. An improved product-holding rotary magazine for moving a product past a slicing knife, comprising a base member rotatable about a central axis, a plurality of openings through the base member for passage of products, an upstanding wall surrounding each said opening and an inside surface thereof inclined relative to said axis, a plurality of elongated product receptacles supported by the base member, each located in part within a said opening and against said inclined surface of the wall, and each inclined relative to said axis, and means removably securing the product receptacles to the base member, said means including a single clamp engaging all of said receptacles.

* * * * *